US010458150B2

(12) United States Patent
Baumhauer

(10) Patent No.: US 10,458,150 B2
(45) Date of Patent: Oct. 29, 2019

(54) KEY AND ASSOCIATED LOCK

(71) Applicant: EVVA Sicherheitstechnologie GmbH, Vienna (AT)

(72) Inventor: Walter Baumhauer, Vienna (AT)

(73) Assignee: EVVA Sicherheitstechnologie GmbH, Vienna (AT)

( * ) Notice: Subject to any disclaimer, the term of this patent is extended or adjusted under 35 U.S.C. 154(b) by 316 days.

(21) Appl. No.: 15/509,858

(22) PCT Filed: Aug. 31, 2015

(86) PCT No.: PCT/EP2015/069843
§ 371 (c)(1),
(2) Date: Mar. 9, 2017

(87) PCT Pub. No.: WO2016/037882
PCT Pub. Date: Mar. 17, 2016

(65) Prior Publication Data

US 2017/0306649 A1 Oct. 26, 2017

(30) Foreign Application Priority Data

Sep. 11, 2014 (AT) ..... A 692/2014

(51) Int. Cl.
*E05B 27/00* (2006.01)
*E05B 29/00* (2006.01)
(Continued)

(52) U.S. Cl.
CPC ..... *E05B 27/0078* (2013.01); *E05B 19/0058* (2013.01); *E05B 19/0064* (2013.01);
(Continued)

(58) Field of Classification Search
CPC ..... E05B 27/0078; E05B 19/0058; E05B 19/0064; E05B 27/0017; E05B 27/0082;
(Continued)

(56) References Cited

U.S. PATENT DOCUMENTS 1,669,115 A 5/1928 Anakin
3,393,542 A * 7/1968 Crepinsek ..... E05B 19/0023 70/358
(Continued)

FOREIGN PATENT DOCUMENTS

DE 515431 1/1931
DE 102010052473 6/2011
(Continued)

OTHER PUBLICATIONS

International Search Report dated Nov. 4, 2015 from International Searching Authority Re. Application No. PCT/EP2015/069843. (7 pages).

*Primary Examiner* — Suzanne L Barrett

(57) ABSTRACT

The invention relates to a key (1) for locking a lock, comprising at least one first surface (2) and at least one second surface (2'), with at least one sensing position (4) provided along the longitudinal extent of the key (1), at which sensing position on the first surface (2) at least one first code (3) is provided for reading in the lock and/or at least one second code (3') is provided on the second surface (2') for reading in the lock, wherein at least one code (3) of the first surface (2) differs at least at one sensing position (4) from the second code (3') at the same sensing position (4). The invention furthermore relates to a lock for a key of this type, and a system made up of at least two locks or lock groups and at least one key according to the invention.

21 Claims, 10 Drawing Sheets

Figure 1A:
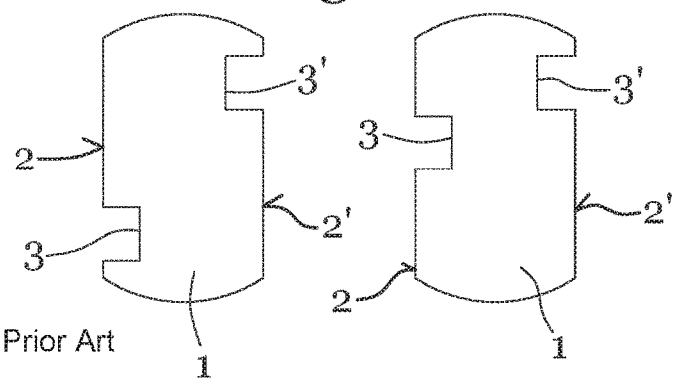
Figure 1B:
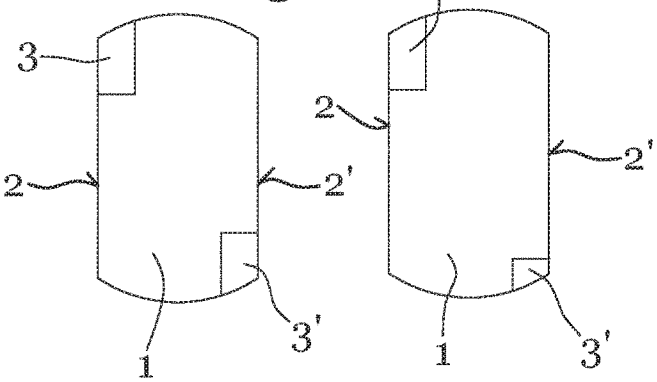
Figure 1C:
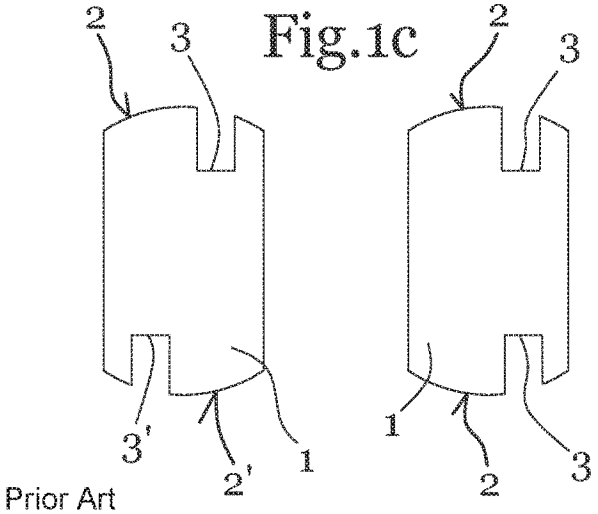
Figure 1D:
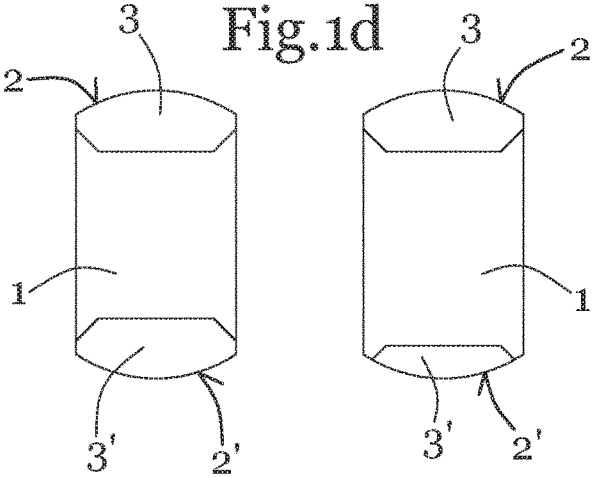

(51) Int. Cl.
*E05B 19/00* (2006.01)
*E05B 27/10* (2006.01)

(52) U.S. Cl.
CPC ..... *E05B 27/0017* (2013.01); *E05B 27/0082* (2013.01); *E05B 27/0096* (2013.01); *E05B 29/0066* (2013.01); *E05B 2027/10* (2013.01)

(58) Field of Classification Search
CPC ..... E05B 27/0096; E05B 29/0066; E05B 27/0053; E05B 27/0085; E05B 47/0045; E05B 2047/10
USPC ..... 70/491–496, 405, 406, 409
See application file for complete search history.

(56) References Cited

U.S. PATENT DOCUMENTS 3,742,744 A * 7/1973 Lumme ..... E05B 27/0042 70/358
4,977,767 A * 12/1990 Prunbauer ..... E05B 27/0082 70/406
5,349,830 A * 9/1994 Keller ..... E05B 19/0023 70/358
5,797,287 A * 8/1998 Prunbauer ..... E05B 27/0042 70/358
5,956,986 A * 9/1999 Vonlanthen ..... E05B 27/0035 70/492
6,041,631 A * 3/2000 Vonlanthen ..... E05B 29/00 70/413
8,276,419 B2 * 10/2012 Farrenkothen ..... E05B 29/00 70/377
8,826,707 B2 * 9/2014 Habecke ..... E05B 19/0017 70/357
2003/0089149 A1 * 5/2003 Suzuki ..... E05B 29/004 70/492
2006/0236733 A1 * 10/2006 Walter ..... E05B 27/0078 70/495
2011/0126600 A1 * 6/2011 Baumhauer ..... E05B 19/0023 70/374
2011/0302972 A1 12/2011 Higuchi
2013/0091911 A1 * 4/2013 Dolev ..... E05B 27/0017 70/493

FOREIGN PATENT DOCUMENTS

| | | |
|---|---|---|
| DE | 102010001790 | 8/2011 |
| EP | 0210037 | 1/1987 |
| EP | 0335069 | 10/1989 |
| EP | 0440983 | 8/1991 |
| EP | 0613987 | 9/1994 |
| EP | 1712714 | 10/2006 |
| WO | WO 91/10795 | 7/1991 |
| WO | WO 2011/098405 | 8/2011 |

* cited by examiner

KEY AND ASSOCIATED LOCK

RELATED APPLICATIONS

This application is a National Phase of PCT Patent Application No. PCT/EP2015/069843 having International filing date of Aug. 31, 2015, which claims the benefit of priority of Austrian Patent Application No. A 692/2014 filed on Sep. 11, 2014. The contents of the above applications are all incorporated by reference as if fully set forth herein in their entirety.

The invention relates to a key for locking a lock with at least one first surface and at least one second surface and at least one sensing position provided along the longitudinal extent, at which sensing position on the first surface at least one first code is provided for reading in the lock and/or at least one second code is provided on the second surface for reading in the lock. The invention furthermore relates to a lock for a key of this type.

FIELD AND BACKGROUND OF THE INVENTION

Keys of this type with two encoded surfaces are known from the prior art, specifically as reversible keys in particular. Reversible keys are keys, the shaft of which has uniformly arranged profiles, guide grooves, depressions, elevations or/and notches on both sides. The key therefore in each case has the same features rotated about the longitudinal axis thereof and can therefore—independently of the side of the key which is pointing upwards—also be introduced into the keyway of the associated lock cylinder in a rotated fashion, which is not possible in the case of a normal key which has notches on one side.

As the codes on reversible keys are identical on both sides, for the most part in the lock, the codes are read on each side alternately, in order to reduce the number of sensing elements. In this context, the term "identical codes" means that the codes are the same on the respectively considered surfaces when the key is rotated about the longitudinal axis thereof.

In reversible keys of this type, the depiction of one side is sufficient however in order to be able to reproduce the key. This is disadvantageous with regards to modern reproduction methods (high-resolution smartphone cameras in combination with 3D printing), as illegal keys can easily be brought into circulation.

SUMMARY OF THE INVENTION

A further problem is that it would be advantageous in practice for two locking systems, which in each case have lock cylinders with reversible keys, to realize superordinate keys which lock in both locking systems.

Furthermore, in the case of reversible keys with a lateral groove code, the problem emerges that the individual curves must be identical on both sides of the key. Limitations for the realization of the grooves at the key tip result however: The central position of the tumbler at the key tip cannot be used, as there would otherwise be an increased danger of breakage.

It is the object of the invention to overcome this and further problems, particularly the problem of ease of copying reversible keys. An option should furthermore be created, in order to be able to lock a plurality of different reversible key locking systems using the same key. Furthermore, the described limitation for the lateral groove code should be overcome. In addition, the variation options on the key should be increased, and greater locking security should be ensured. Identical effects should also be achieved with regards to the new construction of the lock.

This and further objects are achieved according to the invention in that at least one code of the first surface of the key differs at least at one sensing position from the second code at the same sensing position on the second surface, so that to lock the lock, at least the codes at this sensing position must be read at this sensing position on both surfaces.

This has the advantage that the codes are different on both sides of the key and it is consequently substantially more difficult for unauthorized persons to copy the key.

The solution according to the invention makes it possible with one key to lock one or more lock cylinders of a locking system and, if the key is rotated about the longitudinal axis thereof through 90° to 180°, one or more lock cylinders of a different locking system. In this case, it may be provided that a key, which has the same code on both sides, does not have locking authorization. It may however also be provided that a key, which has the same code on both sides, has locking authorization. One advantage of the solution according to the invention is that the feature for the authorization to lock a plurality of locking cylinders does not have to be accommodated in the locking cylinder of the locking systems, rather it is realized with at least two or more features on different surfaces of the key itself. As a result, a key can be designed, which has a superordinate function in two different reversible key locking systems, but does not have the reversible key function itself. This may for example be a superordinate key for authorized persons, such as fire brigades, night watchmen, home helps or the like.

A further advantage of the solution according to the invention, when designing the key with curve codes, is that due to the different shape of the curves on the two sides of the key, the central tumbler at the key tip can then also be used, as it does not have to be milled on both sides in the form of a groove.

It may be provided according to the invention that at least one code of the first surface is identical at least at one sensing position to the code at the same sensing position on the second surface, so that to lock the lock, at least the codes at this sensing position only have to be read on one surface of the key at this sensing position. A plurality of codes may also be present at a sensing position, of which codes one or more is realized identically on all surfaces of the key, and one or more is realized differently on at least one surface of the key.

According to the invention, it may be provided that, in addition to the codes mentioned, further codes may be provided on the surfaces and/or at other locations on the key. The codes mentioned and/or further codes may essentially comprise rectilinear, angled or bent, horizontally or vertically running grooves, channels, milled sections, notches or elevations, control surfaces, control paths, recesses, drilled recesses with identical or different diameters and/or depths, mounted balls, circular or elliptical segment recesses, spherical-segment-shaped elevations or recesses, magnetic codes, electronic codes and/or combinations of these elements.

The invention may provide that the surfaces are key flat sides of a flat key. The invention may likewise provide that the surfaces are key narrow sides of a flat key. The invention may furthermore provide that the first surface is a key narrow side and the second surface is a key flat side. The second surface may enclose an arbitrary angle, particularly approximately 90° or approximately 180°, with the first surface of the key.

The invention may provide that the codes are formed by control points provided transversely to the longitudinal extent of the key and arranged at certain control heights, wherein the control points are preferably connected to one another by control grooves.

The invention may provide that at least one control groove is provided with control points on the first surface and at least one control groove is likewise provided with control points on the second surface, wherein the control points of each control groove are provided at a defined sensing position in each case, and at least one control point of at least one control groove has a different control height at least at one sensing position on the first surface than the control point of the corresponding control groove at the same sensing position on the second surface.

The invention may provide that at least one control point of at least one control groove has the same control height at least at one sensing position on the first surface as the control point of the corresponding control groove at the same sensing position on the second surface. In particular, the invention may provide that at least six sensing positions A-F and at least six control heights a-f are provided.

The invention may provide that at least three control grooves are provided, of which at least one is constructed as a deep control groove with deep control points, and the remaining control grooves are constructed as shallow control grooves with shallow control points, wherein the deep control grooves have a larger groove depth than the shallow control grooves, and the shallow control grooves run essentially parallel to one another.

The invention may provide that at least three, preferably five, control heights are provided for at least one of the control grooves, preferably for the shallow control grooves.

The invention may provide that the codes are initially realized identically on both surfaces on at least one sensing position starting from the key tip in the direction of the key bow, and are continuously realized differently from a certain sensing position. It may in particular be provided that the deep control groove or the shallow control grooves, starting from the key tip in the direction towards the key bow only extend up to a certain sensing position, so that up to this sensing position, at each sensing position on each surface two shallow and one deep control groove are provided, and from this sensing position, at each sensing position only one shallow or two deep control grooves are provided.

The invention furthermore extends to a lock for keys according to the invention, comprising a keyway with at least two sides, with sensing positions provided along the longitudinal extent of the keyway, wherein at least one control element for reading at least one code on at least one surface of the key is provided at each sensing position, wherein at least one locking element is provided, which, given an appropriate position of the control element, can be brought into a released position for actuating the lock, and wherein control elements for reading different codes on at least two surfaces of the key are provided at least at one sensing position on at least two sites of the keyway.

The invention may provide that control elements for reading the same code, particularly for reading different features of the same code, on at least two surfaces of the key are provided at least at a further sensing position on at least two sides of the keyway. It may in particular be provided that the control elements comprise control organs for engaging in codes, particularly for engaging in control grooves on the key.

The invention may provide that the control elements comprise first control organs for engaging in deep control grooves and second control organs for engaging in shallow control grooves. It may furthermore be provided that the control elements for controlling the locking elements have engaging means, particularly one or more reading grooves, which interact with the locking element in one or more positions of the control element in such a manner that the same can be brought into a release position for actuating the lock.

The invention may provide that the key is a flat key and/or the lock is a cylinder lock, particularly a cylinder lock for accommodating a flat key.

The invention furthermore extends to a system made up of at least two locks according to the invention or groups of locks according to the invention and at least one associated key according to the invention, wherein at least one first lock or a first lock group reads at least only the first code on the first surface at least at one specific sensing position, and at least one second lock or a second lock group reads at least only the second code on the second surface of the key at the same sensing position, so that the key locks the first lock or the first lock group in a first position and locks the second lock or the second lock group in a second position.

BRIEF DESCRIPTION OF THE SEVERAL VIEWS OF THE INVENTION

Further features according to the invention emerge from the description of the exemplary embodiments, the patent claims and the drawings.

Figure 2C:
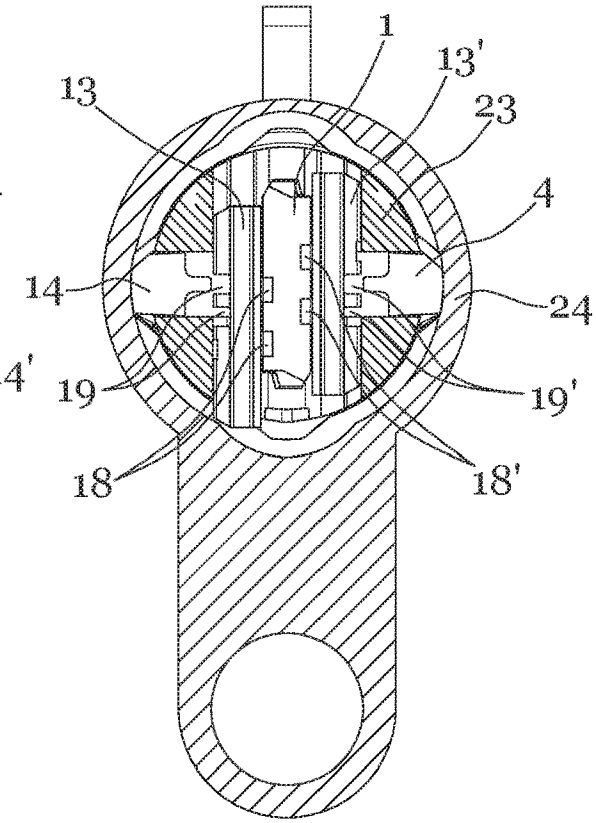
Figure 2B:
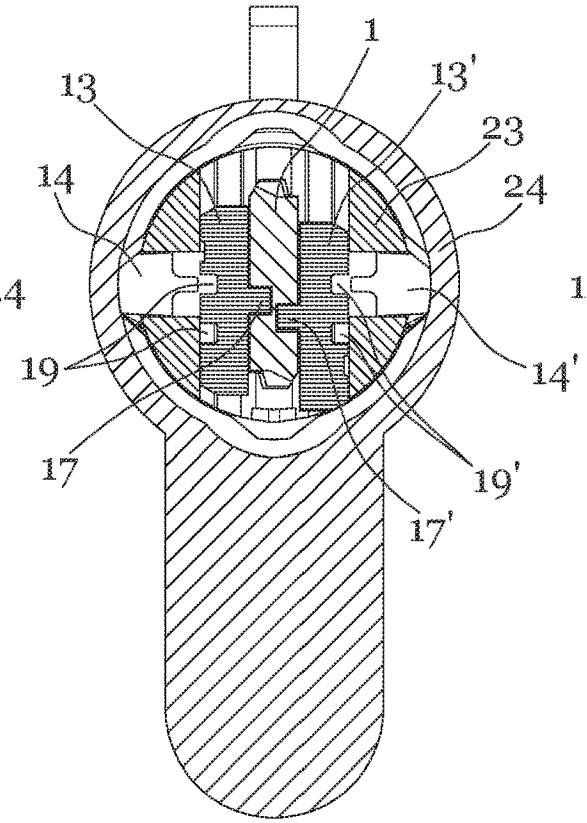
Figure 2A:
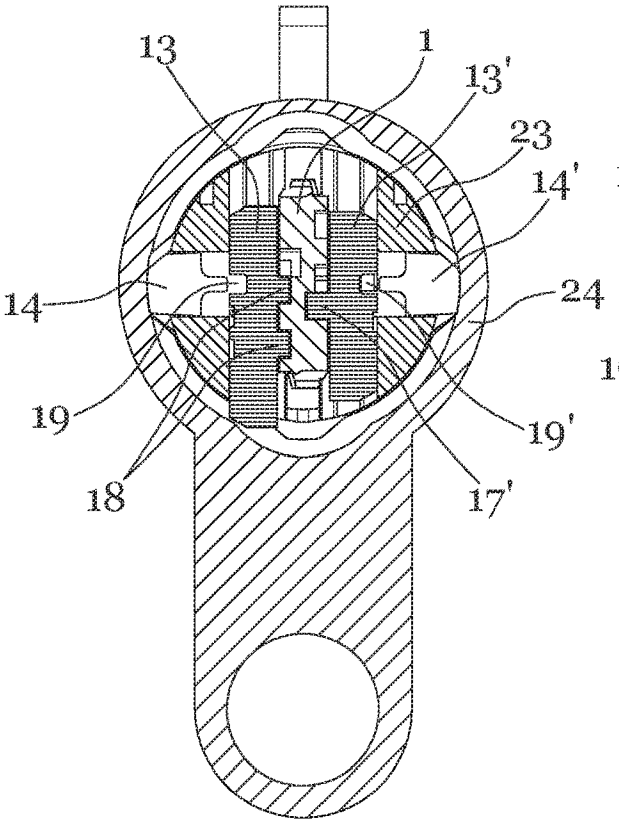
Figure 3A:
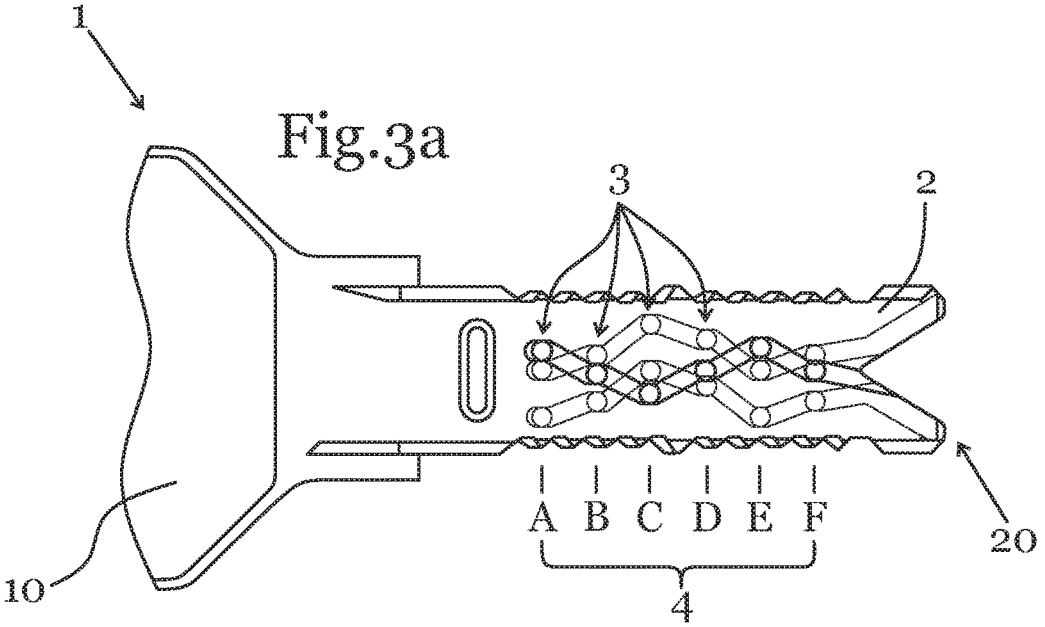
Figure 3B:
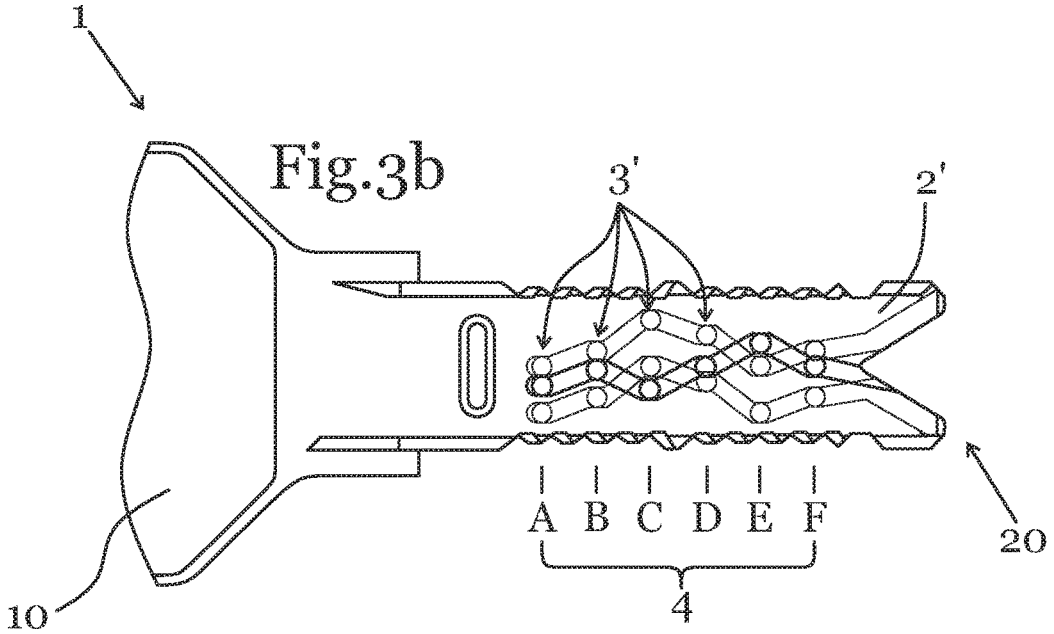
Figure 4A:
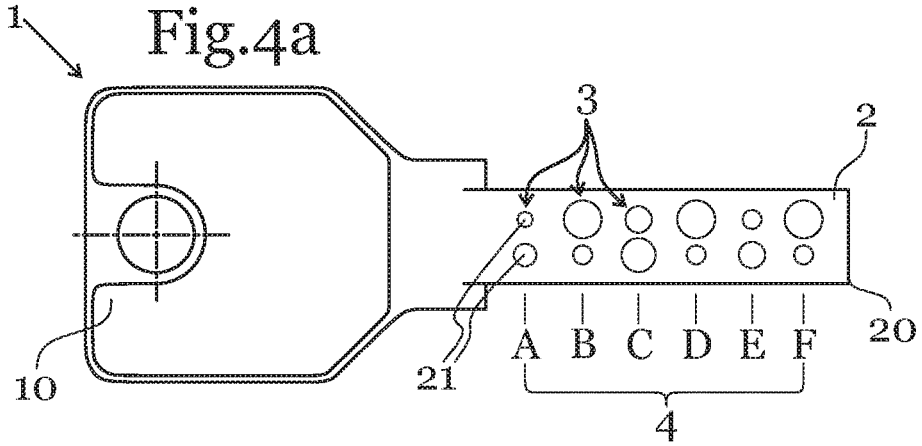
Figure 4B:
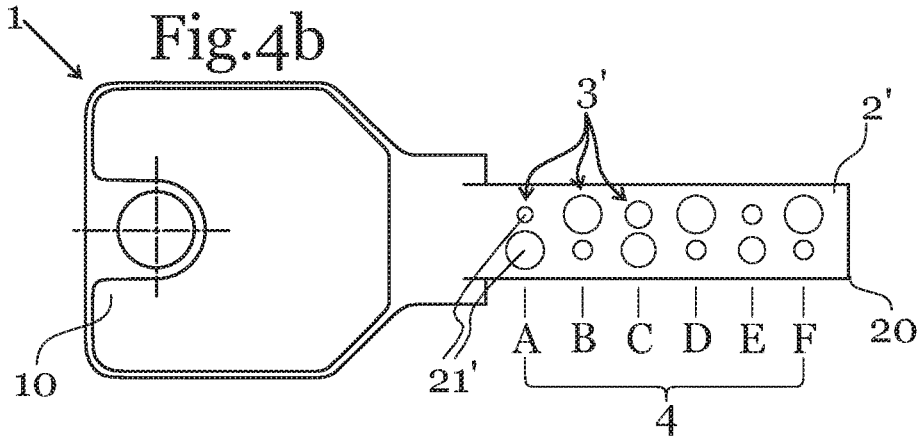
Figure 5A:
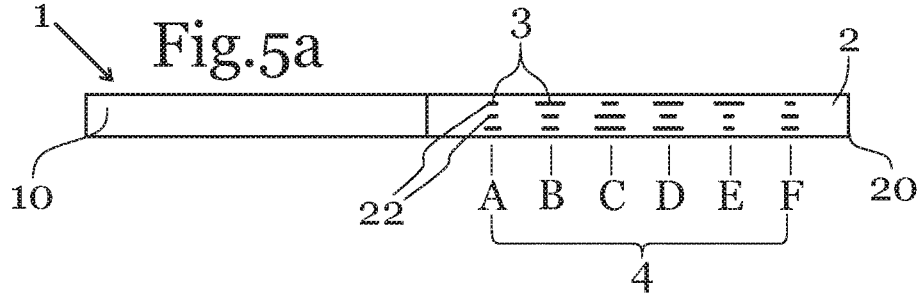
Figure 5B:
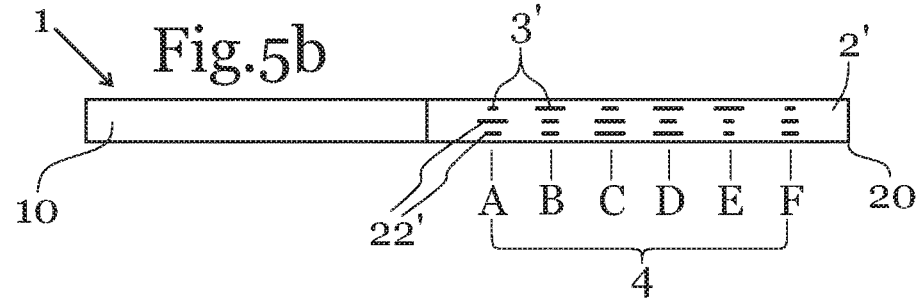
Figure 6A:
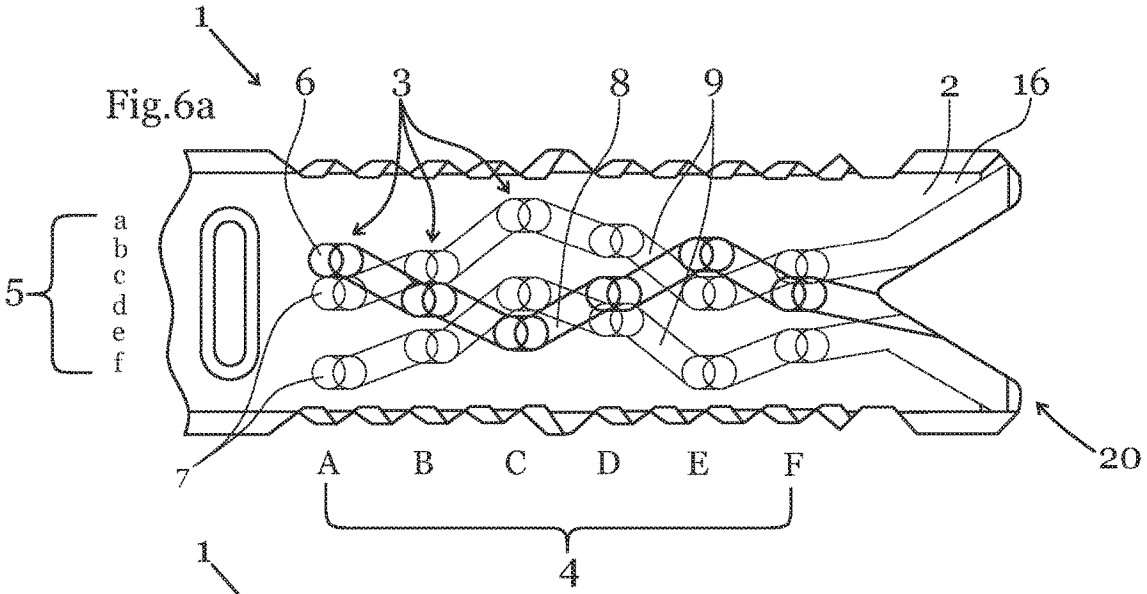
Figure 6B:
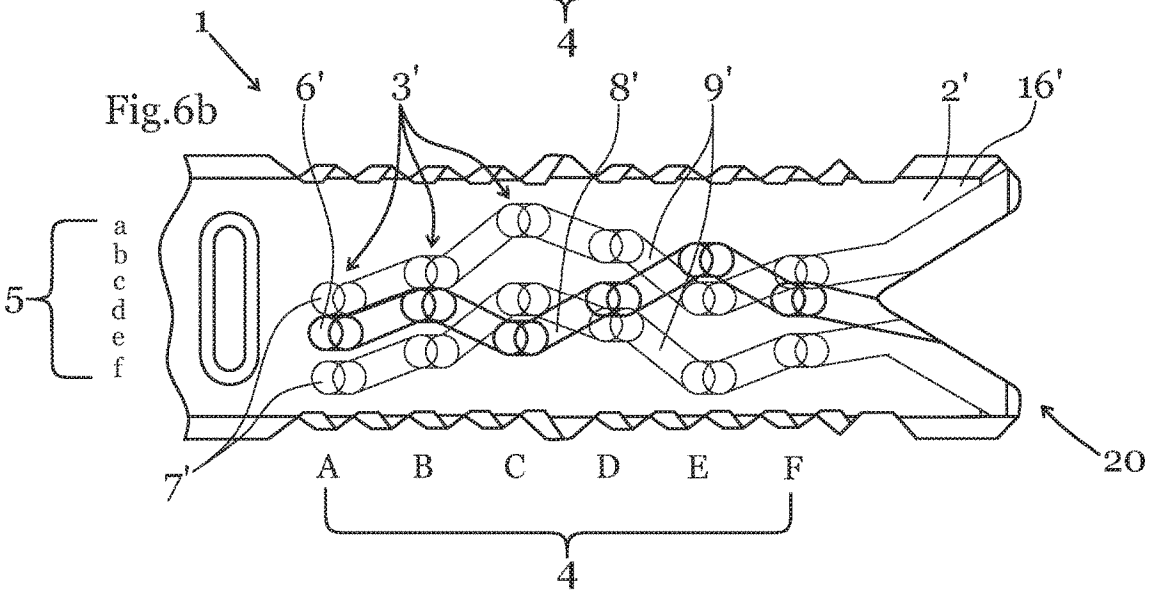
Figure 7A:
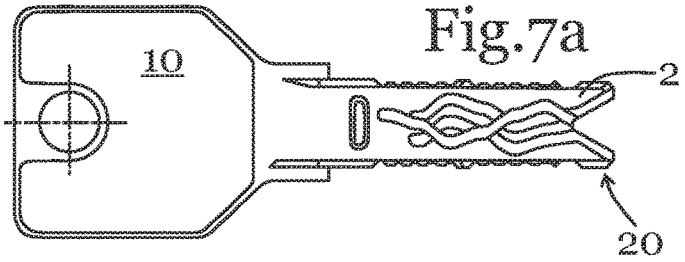
Figure 7B:
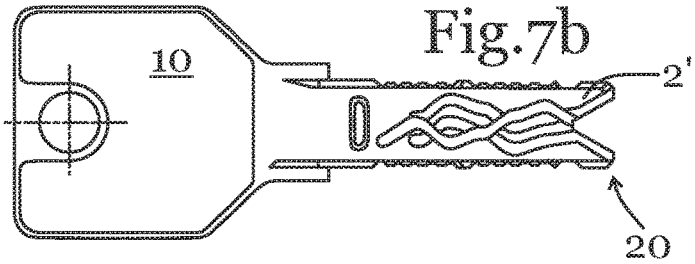
Figure 8A:
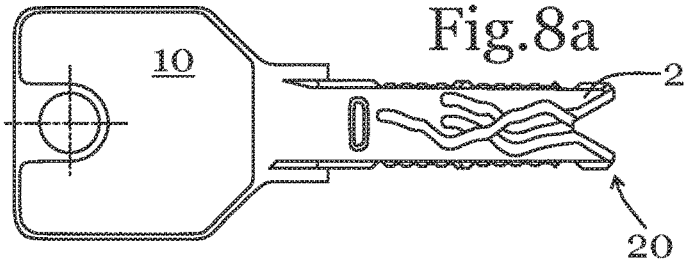
Figure 8B:
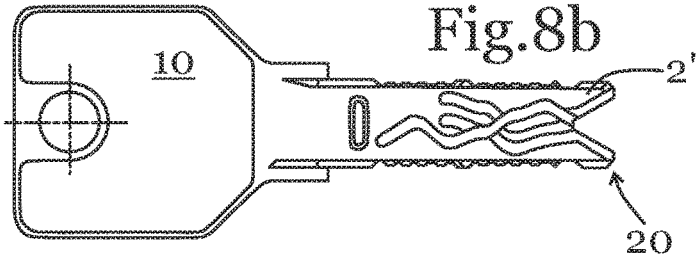
Figure 13A:
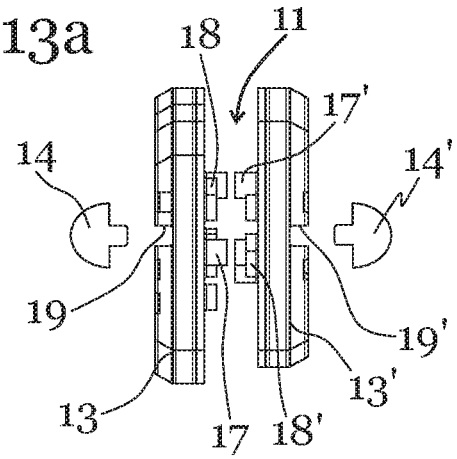
Figure 13B:
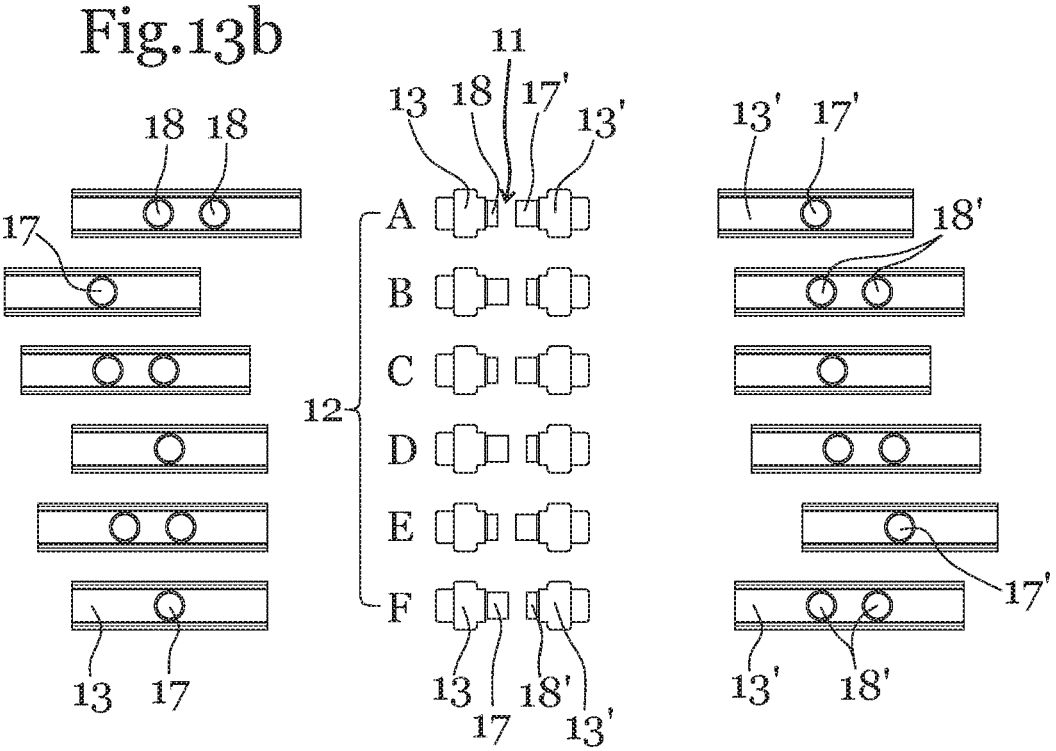
Figure 14:
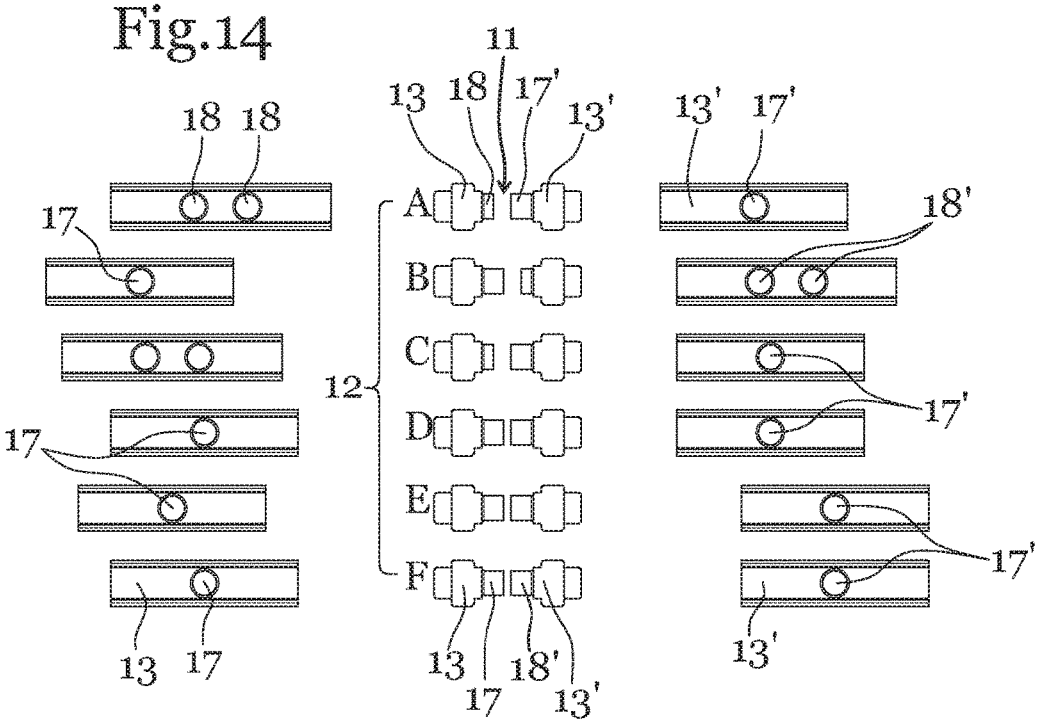
Figure 15:
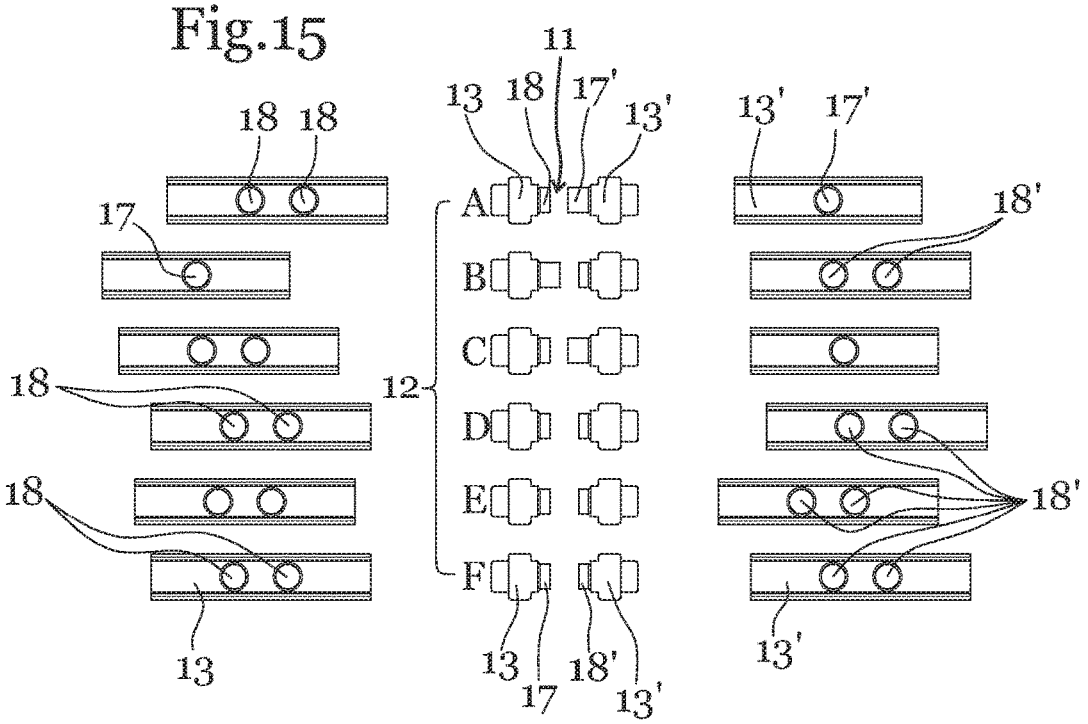
Figure 16A:
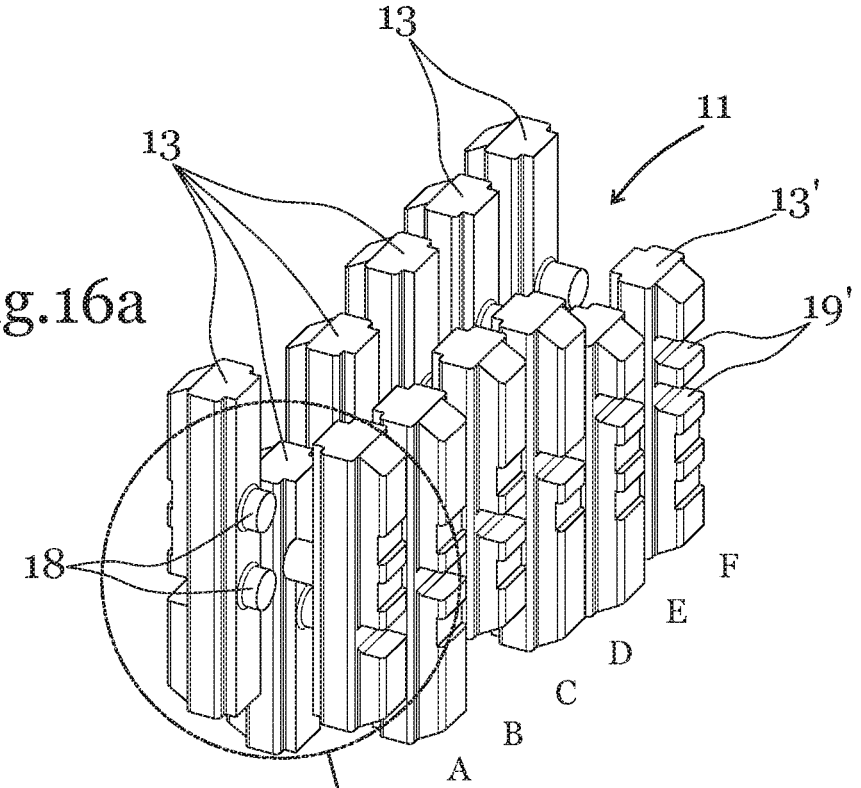
Figure 16B:
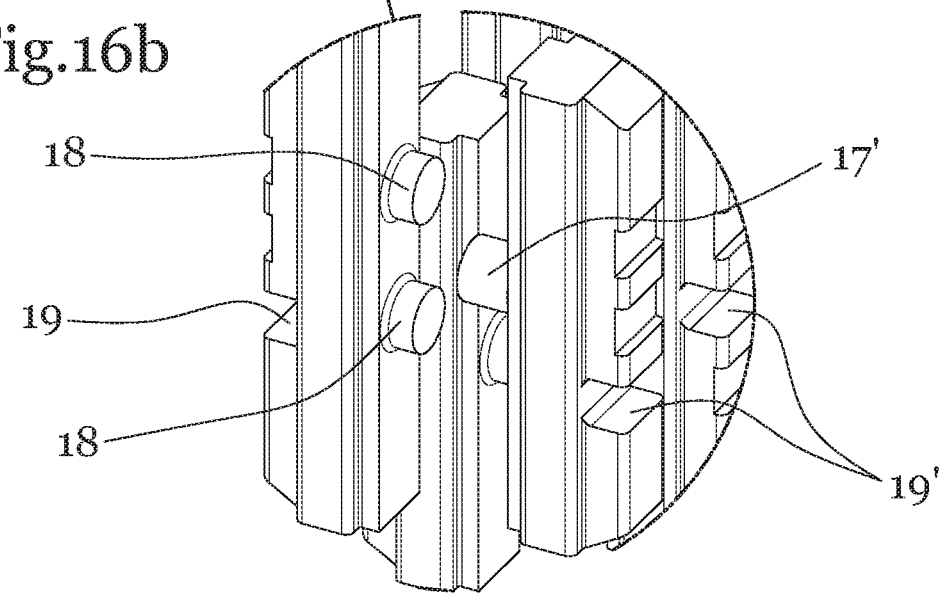

The invention is explained in more detail in the following on the basis of non-limiting exemplary embodiments:

FIGS. 1*a*-1*d* show cross sections through exemplary embodiments of conventional keys (left) and keys according to the invention (right);

FIGS. 2*a*-2*c* show cross sections through exemplary embodiments of conventional key/lock combinations and key/lock combinations according to the invention;

FIGS. 3*a*-3*b* show an exemplary embodiment of a key according to the invention;

FIGS. 4*a*-4*b* show a further exemplary embodiment of a key according to the invention;

FIGS. 5*a*-5*b* show a further exemplary embodiment of a key according to the invention;

FIGS. 6*a*-6*b* show the key from FIGS. 3*a*-3*b* in a detail view;

FIGS. 7*a*-7*b*, 8*a*-8*b*, 9*a*-9*b*, 10*a*-10*b*, 11*a*-11*b* and 12*a*-12*b* show further exemplary embodiments of keys according to the invention;

FIGS. 13*a*-13*b* show a schematic illustration of the tumblers in the interior of the cylinder core of a lock according to the invention;

FIGS. 14-15 show further schematic illustrations of the tumblers in the interior of the cylinder core of a lock according to the invention;

FIGS. 16*a*-16*b* show a schematic three-dimensional illustration of the tumblers in the interior of the cylinder core of a lock according to the invention.

DESCRIPTION OF SPECIFIC EMBODIMENTS OF THE INVENTION

FIGS. 1*a*-1*d* show cross sections through exemplary embodiments of conventional keys and keys 1 according to the invention at a specific sensing position, wherein in each case a cross section through the key shaft of a conventional reversible key is depicted on the left side and a cross section through the key shaft of a key 1 according to the invention is depicted to the right thereof. The keys 1 have a first surface 2 with first codes and a second surface 2' with second codes 3' in each case. While the codes 3, 3' of the conventional keys are realized in such a manner that the keys match when the key is rotated through 180°, this is not the case for the exemplary embodiments of the key 1 according to the invention.

Thus, it makes a difference whether the key is inserted into the lock in the normal position or in a position rotated through 180°. In the lock—at least at this sensing position—both surfaces 2, 2' of the key 1 must be read.

FIGS. 2*a*-2*c* show cross sections through exemplary embodiments of conventional key/lock combinations and key/lock combinations according to the invention. FIG. 2*a* shows a cross section through a conventional lock with a core 23, which is rotatably mounted in a housing 24, into which a conventional key 1 is inserted. Control elements 13, 13' are arranged in a displaceable manner on both sides of the key 1, which control elements interact with locking elements 14, 14' which engage in housing grooves. The key 1 is a key with a lateral groove code. The lock is realized in the conventional manner and reads the two shallow grooves on the side 2 using the control organs 18 and the deep groove on the other side 2' using the control organ 17'. The position of the deep groove on surface 2 and the shallow grooves on side 2' is not read, as it is assumed—owing to the reversible key system—that the codes are the same on both surfaces 2, 2'.

FIG. 2*b* shows a cross section through an exemplary embodiment of a key/lock combination according to the invention. In this case, the codes in the form of deep grooves on the surfaces 2, 2' of the key are different and are also read independently of one another on both sides of the key. In order to be able to read both codes on each surface 2, 2', the locking elements 13, 13' engage on both sides into the deep groove via first control organs 17, 17'.

As the deep groove is at a different position, depending on the rotation of the key 1, however, the control elements 13, 13' each have two reading grooves 19, 19' for engaging the locking elements 14, 14'. The locking elements 14, 14' are therefore activated in two different positions of the control elements 13, 13' in each case and lock the lock. Although the key 1 is not a reversible key—as the codes on surface 2 and 2' are different—the key functions as a reversible key, as both surfaces of the key are read in both positions.

FIG. 2*c* shows an analogous embodiment to FIG. 2*b* with the difference that at the illustrated sensing position of the key 1, the code is not realized by one deep groove per surface 2, 2' in each case, but rather by two shallow grooves 2, 2' per surface in each case. The control elements 13, 13' each have two control organs 18, 18' for engaging in the shallow grooves, and each have two reading grooves 19, 19' for engaging the locking elements 14, 14'. The locking elements 14, 14' are therefore activated, as in the exemplary embodiment of FIG. 2*b*, in two different positions of the control elements 13, 13' in each case and lock the lock, although this is not a reversible key.

In an exemplary embodiment which is not illustrated, the lock has a further mechanical reading logic, particularly of the locking elements 14, 14', which logic ensures that the lock from FIG. 2*b* or FIG. 2*c* cannot be locked by a conventional reversible key with identical codes on the surfaces 2, 2', but rather can be locked exclusively by means of keys with different codes.

FIGS. 3*a*-3*b* show an exemplary embodiment of a key 1 according to the invention, which is realized as a flat key with a key bow 10 and a key tip 20 and two opposite surfaces 2, 2'. The surfaces 2, 2' are the key flat sides 16, 16'. Sensing positions 4 are provided for both surfaces 2, 2' along the longitudinal extent of the key 1, namely six sensing positions A-F. A code 3, 3' is located at each sensing position 4 on both surfaces 2, 2' of the key 1, wherein the first code 3 is provided on the surface 2 and the second code 3' is provided on the surface 2'.

The codes are realized differently on the sensing position A, and identically on the sensing positions B-F. A lock which only senses one side of the key, can therefore only be actuated in one position of the key. In order to be able to read both codes at the sensing position A, the lock must be realized in such a manner that it reads both surfaces 2, 2' of the key 1 independently of one another at least at the sensing position A.

FIGS. 4*a*-4*b* show a further exemplary embodiment of a key 1 according to the invention, which is realized as a flat key with a key bow 10 and a key tip 20 and two opposite surfaces 2, 2'. The surfaces 2, 2' are the key flat sides 16, 16'. Sensing positions 4 are provided for both surfaces 2, 2' along the longitudinal extent of the key 1, namely six sensing positions A-F. A code 3, 3' is located at each sensing position 4 on both surfaces 2, 2' of the key 1, wherein the first code 3 is provided on the surface 2 and the second code 3' is provided on the surface 2'.

The codes are realized differently on the sensing position A, and identically on the sensing positions B-F. In this exemplary embodiment, the codes 3, 3' are realized as drilled recesses 21, 21' with a different depth and/or diameter.

FIGS. 5*a*-5*b* show a further exemplary embodiment of a key 1 according to the invention, which is realized as a flat key with a key bow 10 and a key tip 20 and two opposite surfaces 2, 2'. The surfaces 2, 2' are the key narrow sides 15. Sensing positions 4 are provided for both surfaces 2, 2' along the longitudinal extent of the key 1, namely six sensing positions A-F. A code 3, 3' is located at each sensing position 4 on both surfaces 2, 2' of the key 1, wherein the first code 3 is provided on the surface 2 and the second code 3' is provided on the surface 2'. The codes are realized differently on the sensing position A, and identically on the sensing positions B-F. In this exemplary embodiment, the codes 3, 3' are realized as notches 22, 22' with a different depth and/or extent.

FIGS. 6*a*-6*b* show the key from FIGS. 3*a*-3*b* in a detail view. The key 1 is realized as a flat key with a key tip 20 and two opposite surfaces 2, 2'. The surfaces 2, 2' are the key flat sides 16, 16'. Sensing positions 4 are provided for both surfaces 2, 2' along the longitudinal extent of the key 1, namely six sensing positions A-F.

A code 3, 3' is located at each sensing position 4 on both surfaces 2, 2' of the key 1, wherein the first code 3 is provided on the surface 2 and the second code 3' is provided on the surface 2'. The codes are realized differently on the sensing position A, and identically on the sensing positions B-F.

The codes 3, 3' comprise deep control points 6, 6' and shallow control points 7, 7' which are connected to one another by means of a deep control groove 8, 8' and two shallow control grooves 9, 9' in each case. The deep control grooves 8, 8' have a larger groove depth than the shallow control grooves 9, 9'. The shallow control grooves 9, 9' run substantially parallel to one another.

The control points 6, 6', 7, 7' are arranged at the reading positions at control heights 5 provided transversely to the longitudinal extent of the key 1. Six control heights a-f are provided in this exemplary embodiment. Whilst the control points 6, 6', 7, 7' at the sensing positions B-F are identical on both surfaces 2, 2' of the key 1, the deep control point 6, 6' is arranged at a different control height 5 on the two surfaces 2, 2' at the sensing position A.

FIGS. 7*a*-9*b* show further exemplary embodiments of keys according to the invention. In these exemplary embodiments, starting from the key tip 20 to the key bow 10, the deep control groove 8, 8' initially runs identically on a few sensing positions on both surfaces 2, 2' of the key 1. From a specific sensing position, the deep control groove 8, 8' is realized differently on the surfaces 2, 2'. The shallow control grooves 9, 9' extend, starting from the key tip 20, only up to this specific sensing position.

As a result, this means that up to this sensing position, it is only necessary to read on one side of the key, whilst from this sensing position, both sides of the key must be read (as shown in FIG. 2*b*).

FIGS. 10*a*-12*b* show further exemplary embodiments of keys according to the invention. In these exemplary embodiments, starting from the key tip 20 to the key bow 10, the shallow control grooves 9, 9' initially run identically on a few sensing positions on both surfaces 2, 2' of the key 1.

From a specific sensing position, the shallow control grooves 9, 9' are realized differently on the surfaces 2, 2'. The deep control groove 8, 8' extends, starting from the key tip 20, only up to this specific sensing position. As a result, this means that up to this sensing position, it is only necessary to read on one side of the key, whilst from this sensing position, both sides of the key must be read (as shown in FIG. 2*c*).

FIGS. 13*a*-13*b* show a schematic illustration of the tumblers in the interior of the cylinder core of a lock according to the invention, wherein the key and cylinder core and housing have not been illustrated for reasons of clarity. FIG. 13*a* shows a view into the keyway 11 and shows the control elements 13, 13', which read the keyway using control organs 15, 17', 18, 18'. The control elements 13, 13' have reading grooves 19, 19' on the sides, which interact with locking elements 14, 14'. A plan view of the keyway 11 is illustrated in FIG. 13*b*, and the sensing positions 12 A-F are illustrated. Two control elements 13, 13' are located on both sides of the keyway 11 at each sensing position, which control elements either have first control organs 17, 17' for reading the deep grooves on the key, or second control organs 18, 18' for reading the shallow grooves. The control elements 13, 13' are illustrated once more in a position rotated through 90° to the right and left of the keyway 11. This exemplary embodiment of the lock is realized for a key as illustrated in FIGS. 3*a*-3*b*, as the grooves extend over the entire length of the key shaft.

Figure 9A:
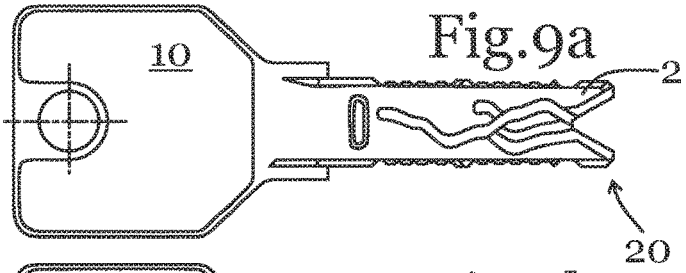
Figure 9B:
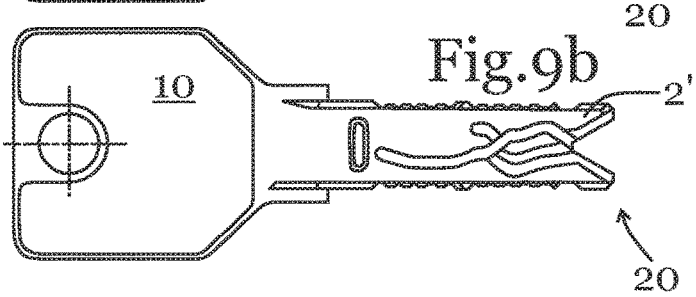
Figure 10A:
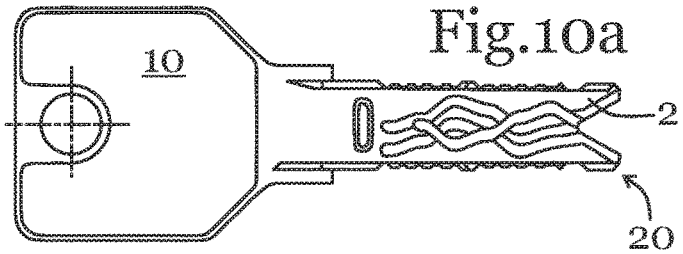
Figure 10B:
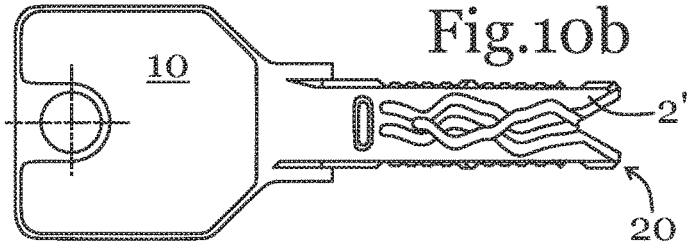
Figure 11A:
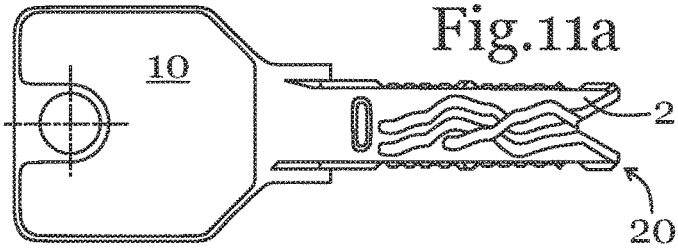
Figure 11B:
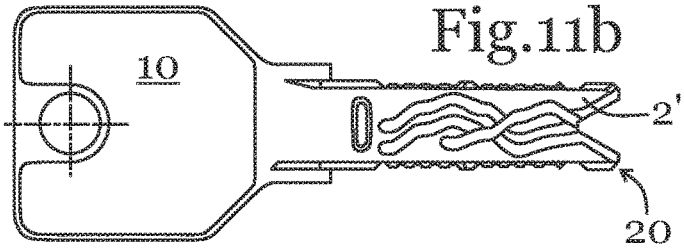

A design of the lock for a key as illustrated in FIGS. 9*a*-9*b* is illustrated in FIG. 14. The deep and shallow grooves of the key are sensed alternately at the sensing positions A, B and C. At the sensing positions D, E and F, only the deep groove is additionally sensed on both sides.

Figure 12A:
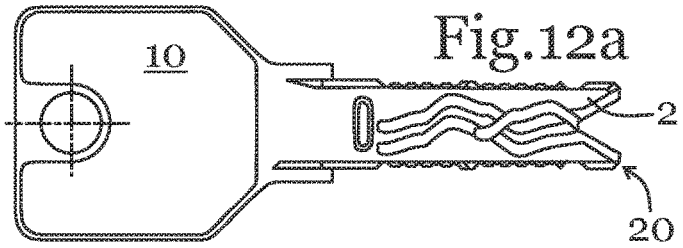
Figure 12B:
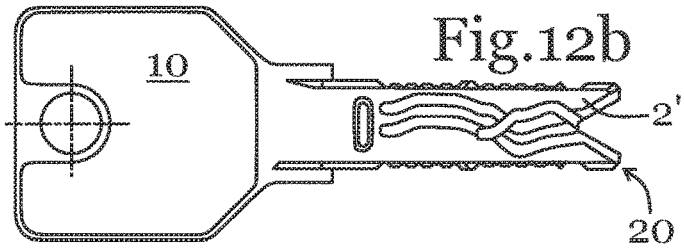

A design of the lock for a key as illustrated in FIGS. 12*a*-12*b* is illustrated in FIG. 15. The deep and shallow grooves of the key are sensed alternately at the sensing positions A, B and C. At the sensing positions D, E and F, only the shallow grooves are additionally sensed on both sides.

FIG. 16 shows a schematic three-dimensional illustration of the tumblers in the interior of the cylinder core of a lock according to the invention, wherein the control elements 13 and 13' are illustrated on both sides of the keyway 11. The first control organs 17' for sensing the deep groove, and the second control organs 18 for sensing the shallow grooves are illustrated in the extracted detail. The control organs 17, 17', 18, 18' are substantially cylindrical elevations.

The reading grooves 19, 19' can likewise be seen in the form of indents with a substantially rectangular cross section, which serve to interact with the locking element 14, 14', as has been illustrated in FIGS. 2*a*-2*c*.

The invention is not limited to the illustrated exemplary embodiments, but rather comprises all embodiments in the context of the patent claims which follow.

REFERENCE LIST

1 Key
2 First surface
2' Second surface
3, 3' Code
4 Sensing position of the key
5 Control height
6, 6' Deep control point
7, 7' Shallow control point
8, 8' Deep control groove
9, 9' Shallow control groove
10 Key bow
11 Keyway
12 Sensing position of the lock
13, 13' Control element
14, 14' Locking element
15, 15' Key narrow side
16, 16' Key flat side
17, 17' First control organ
18, 18' Second control organ
19, 19' Reading groove
20 Key tip
21, 21' Drilled recesses
22, 22' Notches
23 Core
24 Housing

What is claimed is:

1. A key (1) for locking a lock, comprising a. at least one first surface (2) and at least one second surface (2'), b. with a plurality of sensing positions (4) provided along a longitudinal extent of the key (1), c. at which plurality of sensing positions on the first surface (2) at least one first code (3) is provided for reading in the lock and at least one second code (3') is provided on the second surface (2') for reading in the lock, wherein the at least one first code (3) of the first surface (2) differs, at least at one sensing position, (4) from the at least one second code (3') at the same sensing position (4), wherein the at least one first and second codes (3, 3') are configured, at least at a first sensing position of the plurality of sensing positions (4), so that to lock the lock, the codes at said at least a first sensing position must be read on both surfaces (2, 2'), wherein, at at least a second sensing position (4) of the plurality of sensing positions, the at least one first code (3) of the first surface (2) is identical to the at least one second code (3') on the second surface (2'), so that to lock the lock, the codes (3, 3') at the at least a second sensing position only have to be read on one surface (2, 2') of the key.

2. The key according to claim 1, wherein further codes are provided in addition to the at least one first code and at least one second code (3, 3') on the first surface and second surface (2, 2') and/or at other locations on the key (1).

3. The key (1) according to claim 1, wherein the codes (3, 3') comprise rectilinear, angled or bent, horizontally or vertically running grooves, channels, milled sections, notches (22, 22') or elevations, control surfaces, control paths, recesses, drilled recesses (21, 21') with identical or different diameters and/or depths, mounted balls, circular or elliptical segment recesses, spherical-segment-shaped elevations or recesses, magnetic codes, electronic codes and/or combinations of these elements.

4. The key (1) according to claim 1, wherein the at least one first surface and at least one second surface (2, 2') are key flat sides (16, 16').

5. The key (1) according to claim 1, wherein the at least one first surface and at least one second surface (2, 2') are key narrow sides (15, 15').

6. The key (1) according to claim 1, wherein the at least one first surface (2) is a key narrow side (15) and the at least one second surface (2') is a key flat side (16').

7. The key (1) according to claim 1, wherein the codes (3, 3') are formed by control points (6, 6', 7, 7') provided transversely to the longitudinal extent of the key (1) and arranged at certain control heights (5), wherein the control points are connected to one another by control grooves (8, 8', 9, 9').

8. The key (1) according to claim 7, wherein a. at least one control groove (8, 9) is provided with control points (6, 7) on the at least one first surface (2) and at least one control groove (8', 9') is provided with control points (6', 7') on the at least one second surface (2'), b. wherein the control points of each control groove are provided at defined sensing positions (4), and c. at least one control point of at least one control groove has a different control height at least at one sensing position on the first surface (2) than the control point of the corresponding control groove at the same sensing position on the second surface (2').

9. The key (1) according to claim 8, wherein at least one control point of at least one control groove has the same control height at least at one sensing position on the first surface (2) as the control point of the corresponding control groove at the same sensing position on the second surface (2').

10. The key (1) according to claim 8, wherein at least six sensing positions A-F and at least six control heights a-f are provided.

11. The key (1) according to claim 8, wherein at least three control grooves are provided, of which at least one is constructed as a deep control groove (8, 8') with deep control points (6, 6'), and the remaining control grooves are constructed as shallow control grooves (9, 9') with shallow control points (7, 7'), a. wherein the deep control grooves (8, 8') have a larger groove depth than the shallow control grooves (9, 9'), b. and the shallow control grooves (9, 9') run essentially parallel to one another.

12. The key (1) according to claim 11, wherein at least three control heights are provided for at least one control groove.

13. The key according to claim 1 with a key tip (20) and a key bow (10), wherein the at least one first and second codes (3, 3') are initially configured identically on both surfaces (2, 2') on at least one sensing position (4) starting from the key tip (20) in the direction of the key bow (10), and are continuously configured differently from a second sensing position.

14. The key according to claim 11 with a key tip (20) and a key bow (10), wherein the deep control groove (8, 8') or the shallow control grooves (9, 9'), starting from the key tip (20) in the direction towards the key bow (10) only extend up to one of the one or more sensing positions (4).

15. A lock for keys (1) according to claim 1, comprising a. a keyway (11) with at least two sides, b. with at least one sensing position (12) provided along a longitudinal extent of the keyway (11), c. wherein at least one control element (13, 13') for reading at least one code (3, 3') on at least one surface (2, 2') of the key (1) is provided at each sensing position (12), d. wherein at least one locking element (14, 14') is provided, which is configured to engage with the at least one control element (13, 13'), and, the at least one locking element (14, 14'), when engaged with the at least one control element (13, 13') in a particular position, can be brought into a released position for actuating the lock, wherein control elements (13, 13') for reading different codes (3, 3') on two surfaces (2, 2') of the key are provided for at least at one sensing position (12) on two sides of the keyway (11).

16. The lock according to claim 15, wherein control elements (13, 13') for reading different features of the same code (3, 3'), on two surfaces (2, 2') of the key are provided at least at a further sensing position (12) on two sides of the keyway (11).

17. The lock according to claim 16, wherein the control elements (13, 13') comprise control organs (17, 17', 18, 18') for engaging in codes (3, 3'), particularly for engaging in control grooves (8, 8', 9, 9') on the key (1).

18. The lock according to claim 17, wherein the control elements (13, 13') comprise first control organs (17, 17') for engaging in deep control grooves (8, 8') and second control organs (18, 18') for engaging in shallow control grooves (9, 9').

19. The lock according to claim 15, wherein the control elements (13, 13') for controlling the locking elements (14, 14') have engaging means, particularly one or more reading grooves (19, 19'), which interact with the locking element (14, 14') in one or more positions of the control element (13, 13') in such a manner that the locking element (14, 14') can be brought into a release position for actuating the lock.

20. The lock according to claim 15, wherein the lock is a cylinder lock for accommodating a flat key.

21. A system made up of at least two locks or lock groups according to claim 15 and at least one associated key (1) for locking a lock, comprising a. at least one first surface (2) and at least one second surface (2'), b. with at least one sensing position (4) provided along the longitudinal extent of the key (1), c. at which sensing position on the first surface (2) at least one first code (3) is provided for reading in the lock and at least one second code (3') is provided on the second surface (2') for reading in the lock, wherein at least one code (3) of the first surface (2) differs at least at one sensing position (4) from the second code (3') at the same sensing position (4);

wherein a. at least one first lock or a first lock group reads at least only the first code (3) on the first surface (2) of the key at least at one specific sensing position, and b. at least one second lock or a second lock group reads at least only the second code (3') on the second surface (2') of the key at the same sensing position, c. so that the key (1) locks the first lock or the first lock group in a first position and in a second position locks the second lock or the second lock group.

* * * * *